US005135200A

United States Patent [19]

Neibrandt

[11] Patent Number: 5,135,200

[45] Date of Patent: Aug. 4, 1992

[54] SNOWMOBILE JACK

[76] Inventor: Kirk B. Neibrandt, Box 191, Rhein, Saskatchewan, Canada, S0A 3K0

[21] Appl. No.: 713,520

[22] Filed: Jun. 12, 1991

[51] Int. Cl.[5] ..... B66F 3/00

[52] U.S. Cl. ..... 254/114; 254/119; 254/131

[58] Field of Search ..... 254/113-119, 254/2 B, 131, 134, 120

[56] References Cited

U.S. PATENT DOCUMENTS

| | | | |
|---|---|---|---|
| 1,825,702 | 10/1931 | Newton | 254/114 |
| 3,667,728 | 6/1972 | Garelick | 254/131 |
| 3,768,778 | 10/1973 | Arnes | 254/2 B |
| 3,871,054 | 3/1975 | Schaefer | 254/131 |
| 3,907,254 | 9/1975 | Richards | 254/131 |
| 3,964,729 | 6/1976 | Harlow | 254/131 |
| 4,457,492 | 7/1984 | Lahti | 254/114 |
| 4,643,396 | 2/1987 | Beals | 254/116 |
| 5,000,423 | 3/1991 | Snickers | 254/131 |

*Primary Examiner*—Robert C. Watson

*Attorney, Agent, or Firm*—Adrian D. Battison; Stanley G. Ade; Murray E. Thrift

[57] ABSTRACT

A snowmobile jack is described herein that raises the rear of the snowmobile off of the ground when it is not in use. Manufacturers suggest that snowmobiles be raised when not in use, so that their tracks do not freeze to the ground. Manufacturers also recommend that snowmobiles be warmed up with their tracks elevated. This cuts down on general wear and tear of the tracks and supporting belts. The jack comprises a vertical lift bar slidable within a sleeve. The bar is raised by a foot pedal lever which acts on the lower end of the bar and is latched in the raised position. The bar carries a transverse rod adjustable in height relative thereto with hooks for engaging the rear bumper of the snowmobile.

3 Claims, 3 Drawing Sheets

SNOWMOBILE JACK

FIELD OF THE INVENTION

The present invention relates to the field of jacks, more particularly to a snowmobile jack.

BACKGROUND OF THE INVENTION

Snowmobiles have enjoyed great popularity for many years. The manufacturers of many snowmobiles recommend that the rear tracks of the snowmobile be raised off of the ground when not in use, as they may freeze to the ground. The manufacturers also recommend that the tracks be warmed up, off of the ground prior to use. This extends the life of the belts and cuts down on general wear and tear.

Most owners of snowmobiles who do raise their vehicles (when not in use), as recommended, lift the vehicle onto a box or crate when not in use. Snowmobiles are heavy, and lifting by one person is quite difficult. The lifting could also lead to an injury such as back strain.

At the present time there is no device available that assists in the raising of a snowmobile to keep it elevated when not in use.

SUMMARY OF THE INVENTION

It is an object of the present invention therefore to provide an adjustable jack for snowmobiles that attaches to a rearward bar on the snowmobile and lifts the rear portion of the vehicle off of the ground when not in use.

In accordance with the present invention there is provided a snowmobile jack, said jack comprising a base; an elongate guide member attached to said base and extending upwardly therefrom, said guide member having a slot thereon, said slot extending upwardly from the said base; an elongate bar, said bar extending upwardly from the base and within the said guide member, said bar slidable within the said guide member, said bar having a top end and a bottom end, said top end having means thereon for engaging and lifting a rear portion of a snowmobile; a lever having a first end and a second end, a fulcrum attached between the first end and the second end, said first end being operably connected to the bottom end of the elongate bar, said second end having manually actuable means thereon, said lever being upwardly displacable along the said slot causing the elongate bar to move to an upwardly displaced position along said guide member; and latch means for releasibly latching the upwardly displaced elongate bar.

The present invention lifts the snowmobile, and therefore the tracks of the snowmobile, off of the ground when the snowmobile is not in use. This extends the life of the belts and cuts down on the wear and tear on the belts and supporting parts.

The present invention also provides the means for warming up the tracks and belts above the ground before using the snowmobile. The jack attaches to a rear bar found on most snowmobiles that is normally used for lifting the vehicle by hand.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 3:
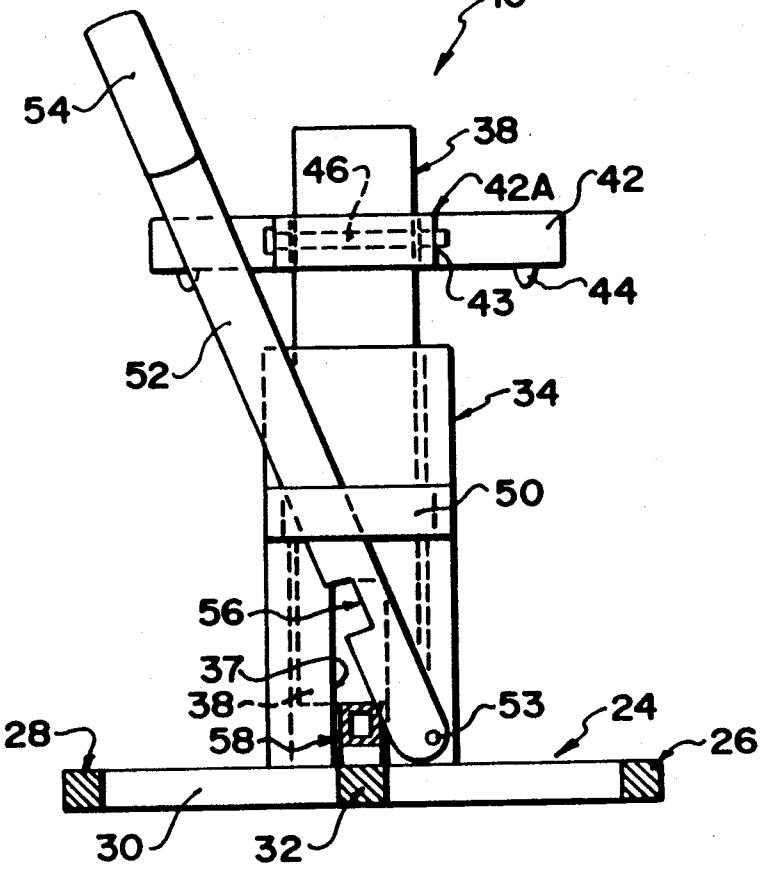
FIG. 3 is a rear view of the preferred embodiment, partially in cross section, along the lines 3—3 of FIG. 2.
Figure 1:
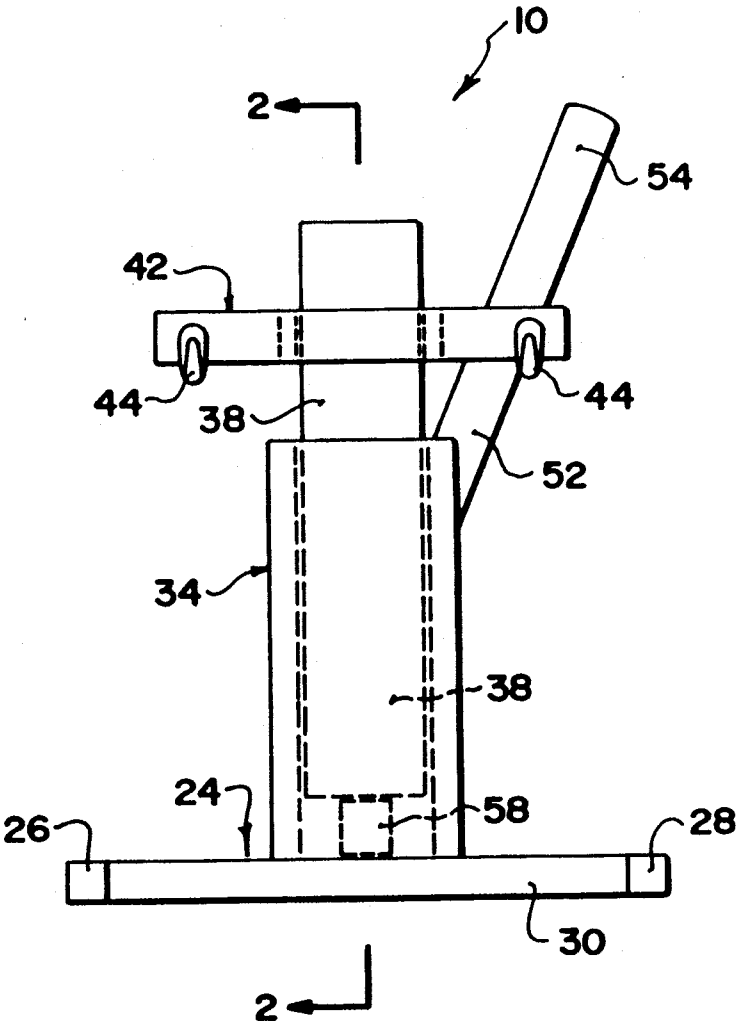
FIG. 1 is a front view of a preferred embodiment of the invention.
Figure 2:
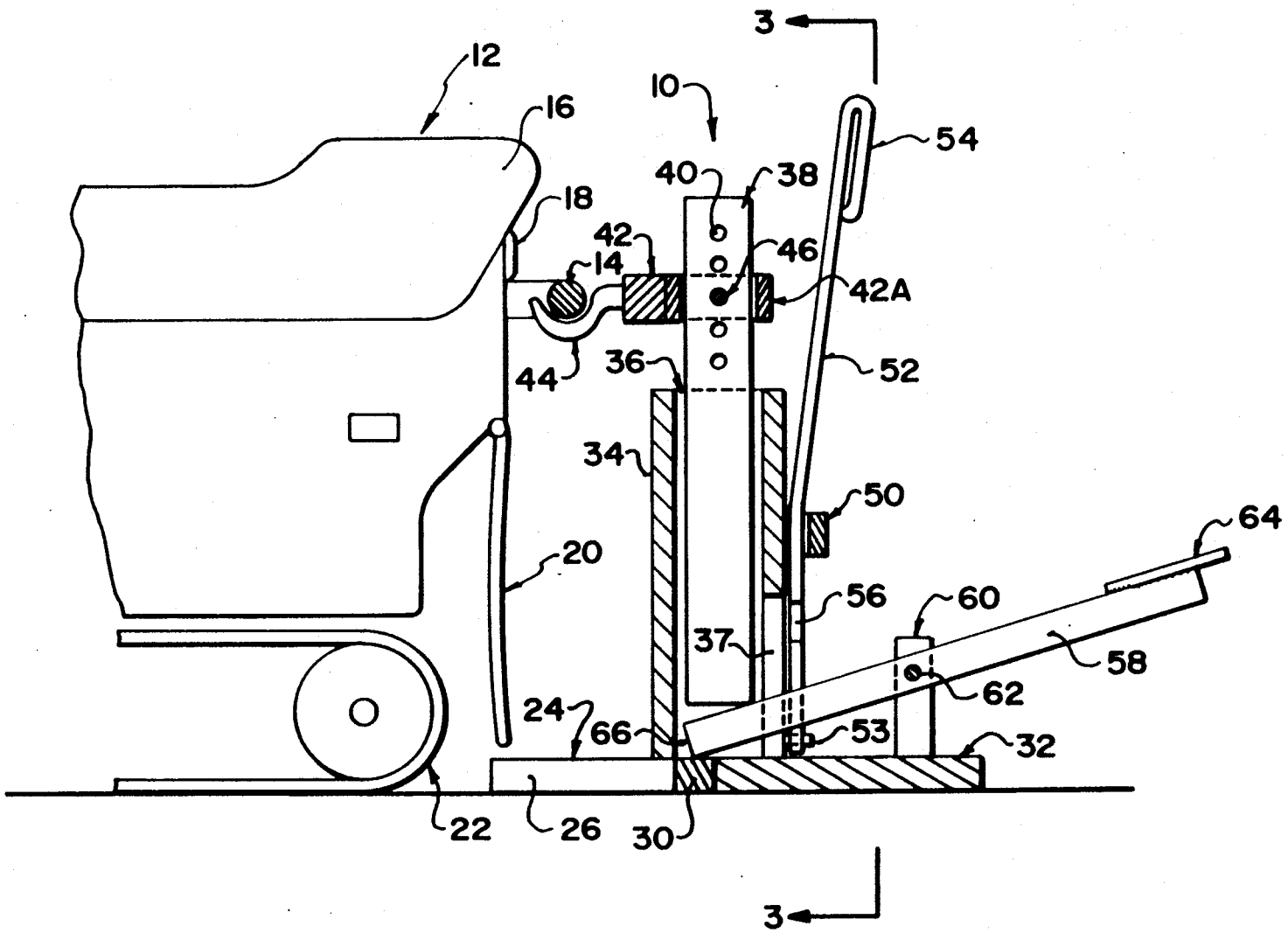
FIG. 2 is a cross sectional side view of the preferred embodiment attached to a snowmobile in the ready position, along the lines 2—2 of FIG. 1.
Figure 4:
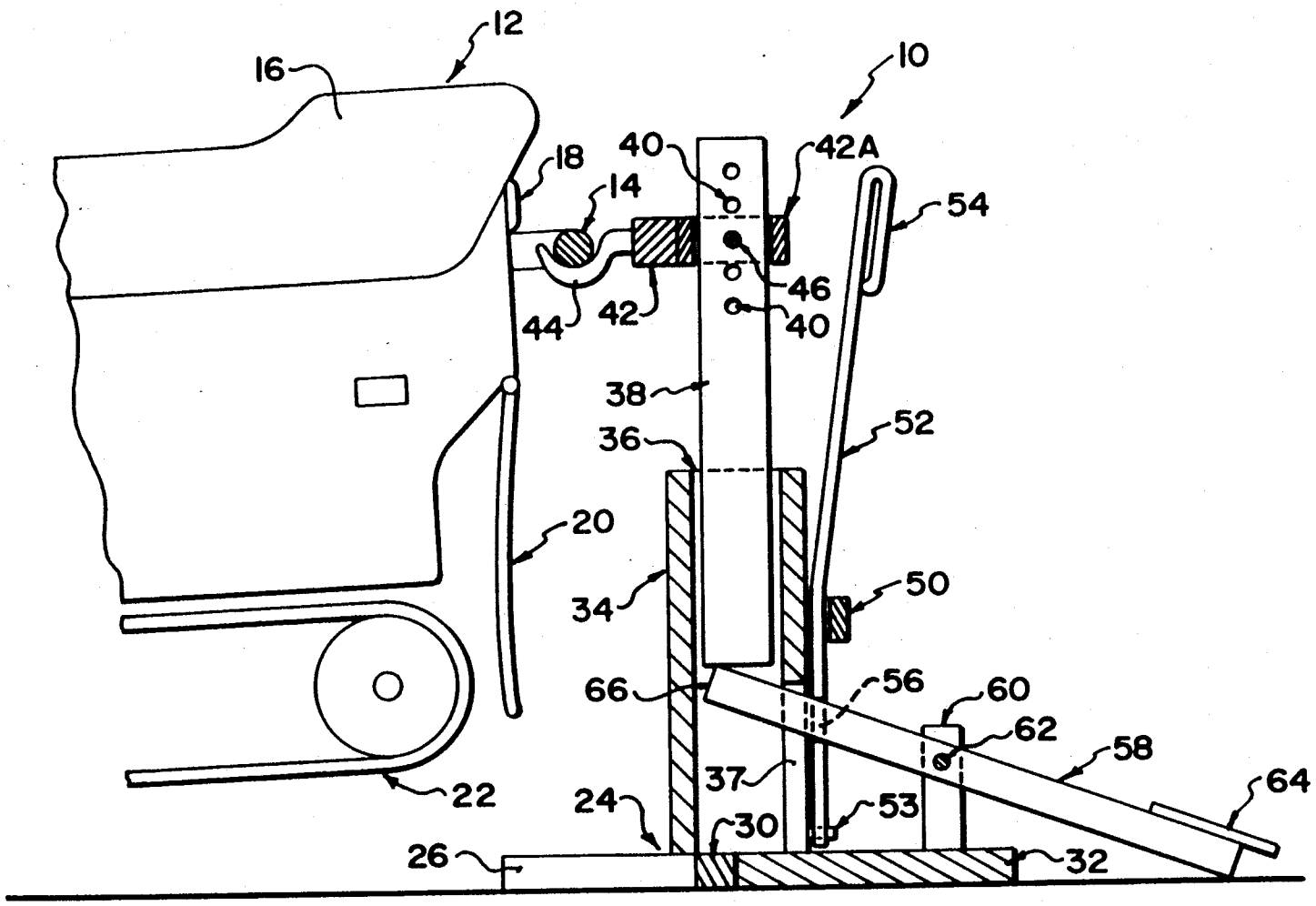
FIG. 4 is a cross sectional side view of the preferred embodiment, as shown in FIG. 2, attached to a snowmobile in the operable position.

A snowmobile jack is shown generally at 10. It attaches to a snowmobile shown generally at 12. The snowmobile has a rear bar 14 attached to and extending vertically from the back of the snowmobile. The snowmobile further has a seat 16, a tail light 18 just above the bar 14, a mud flap 20 below the bar 14, and tracks 22.

The jack 10 has a base frame 24 arranged to lie on a surface, comprised of two parallel elongate bars 26 and 28 connected by a transverse bar 30. Extending rearwardly from a central portion of the transverse bar 30 is a rearward bar 32. An elongate guide member or tube 34 is attached to and extends upwardly from the transverse bar 30. The guide member 34 has an opening 36 at its top, and a rearwardly positioned slot 37 extending upwardly from the base bar 30 to a position approximately at mid height of the guide member 34.

A vertical strut 38 in the form of a tube is slidably associated within the guide member 34. The vertical strut 38 has a plurality of transverse openings 40 therethrough at vertically spaced positions, near the top of the bar. A projecting support member 42 includes a collar 42A surrounding the strut 38. The collar has corresponding openings 43 for alignment with one of the openings 40 on the vertical strut 38. Thus the collar can slide vertically but can be locked at a required height by a transverse pin 46. A pair of hooks 44 extend outwardly from the projecting member 42.

A transverse retaining plate 50 is positioned rearwardly on the guide member 34, upwardly of the slot 37. The transverse retaining plate 50 provides means for loosely retaining a metal strap 52. The metal strap 52 acts as a latch and has a looped handle portion 54 at its top, and a notch 56 positioned midway thereon, generally at a position vertically aligned with the top of the slot 37 on the guide member 34. The strap 52 is pivotally attached at a support pin 53 near the base of the guide member 34.

An elongate lever 58 is positioned on a fulcrum 60 on the rearward extending bar 32. The fulcrum 60 has a pivot pin 62 extending transversely through the tubular lever 58. The lever 58 has a pedal 64 at one end, and its other end 66 is positioned under the bottom end of the elongate vertical bar 38.

In operation, the adjustable hooks 44 are positioned under the rear bumper bar 14 of the snowmobile 12. The hooks 44 are adjusted on the vertical bar 38 to engage the underside of bar 14 and the projecting member 42 is fastened to the vertical bar 38 by aligning the hole 43 with a selected one of the holes 40 on the vertical bar 38 and placing the pin 46 therethrough.

The lower end 66 of the lever 58 is positioned below the bottom end of the sliding vertical bar 38. The lever 58 extends upwardly and outwardly from the guide member 34, pivoting on the fulcrum 60 and extending to the foot pedal 64. By stepping on the foot pedal 64, the lever 58 displaces, thereby causing the pedal end of the lever to move downward and the forward end 66 to move upward, along the slot 37 thereby displacing the vertical bar 38 upwardly within the guide member 34. As a result, the hook 44 projecting from the attachment 42, raises the snowmobile from the underside of bar 14, off of the ground.

The strap 52 within the retaining member 50 is moved by engagement with the lever 58, in a counterclockwise direction as the lever is raised. When the lever reaches the notch 56, the strap 52 falls clockwise under gravity and the lever 58 is held within the notch 56 of the strap 52. The strap 52 thus acts as a latch and prevents the lever from returning to the ready position until the operator decides to lower the vehicle.

To return the lever to the ready position, a slight downward pressure is excerted on the foot pedal 64, along with a pivotal movement of the strap 52 by grasping the handle 54 and moving the strap within the sleeve 50, away from the lever 58 thus causing the notch 56 on the strap 52 to disengage the lever 58. The user then allows the pedal end of the lever 58 to gradually rise by slowly releasing the pressure on the foot pedal 64. The lever 58 moves downwardly along the slot 37 to its ready position.

In the embodiment described, the parallel elongate bars 26 and 28 are positioned generally in the same direction as the snowmobile that is attached to the jack. The bars 28 and 26 are spaced apart at a distance approximately equal to that of the width of the snowmobile, to provide adequate weight distribution and prevent a tipping of the jack attached to the snowmobile.

In the jack's operable position, the tracks are raised off of the ground, as recommended by many manufacturers, when the snowmobile is not in use. It also allows the owner of the snowmobile to warm up the tracks off of the ground prior to use, as recommended by the manufacturer.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A snowmobile jack, said jack comprising:

a base frame for resting on a ground surface;

an elongate guide member attached to said base frame and extending upwardly therefrom, said guide member having a slot thereon, said slot extending upwardly from the said base frame;

an elongate bar, said bar extending upwardly from the base frame and within the said guide member, said bar slidable within the said guide member, said bar having a top end and a bottom end, said top end having means thereon for engaging a rear portion of a snowmobile for lifting thereof;

a foot lever having a first end and a second end, a fulcrum attached between the first end and the second end allowing pivotal movement about a substantially horizontal axis, said first end including means engaged with the bottom end of the elongate bar, said second end having a foot pad thereon, such that depression of the foot pad by the foot of the user causes the first end to be upwardly displaced causing the elongate bar to move to an upwardly displaced position along said slot of said guide member; and latch means comprising an elongate metal strap, the strap being held within sleeve means mounted on said guide member on a side thereof adjacent said foot lever, said strap having a top extending up above the lever and a bottom end pivotally attached adjacent said base allowing movement of the strap from side to side within said sleeve means in a direction transverse to the length of the lever, and notch means on the strap for engaging said lever for holding said lever in a raised position of the first end thereof for releasibly latching the elongate bar in the upwardly position.

2. A snowmobile jack, said jack comprising:

a base frame for resting on a ground surface;

an elongate guide member attached to said base frame and extending upwardly therefrom, said guide member having a slot thereon, said slot extending upwardly from the said base frame;

an elongate bar, said bar extending upwardly from the base frame and within the said guide member, said bar slidable within the said guide member, said bar having a top end and a bottom end, said top end having engaging means thereon for engaging a rear portion of a snowmobile for lifting thereof;

said engaging means comprising a horizontal bar attached adjacent the top end of the elongate bar and having two hook members at spaced position along the horizontal bar extending outwardly from the horizontal bar for engaging a rear portion of the snowmobile, and means for adjustment of the horizontal bar to different positions along the length of the elongate bar;

a foot lever having a first end and a second end, a fulcrum attached between the first end and the second end allowing pivotal movement about a substantially horizontal axis, said first end including means engaged with the bottom end of the elongate bar, said second end having a foot pad thereon, such that depression of the foot pad by the foot of the user causes the first end to be upwardly displaced causing the elongate bar to move to an upwardly displaced position along said slot of said guide member, said lever and said fulcrum being arranged such that the first end moves from a position adjacent the ground surface at the base end of said guide member to said upwardly displaced position while said foot pad moves from a raised position to a position closely adjacent the ground surface; and latch means mounted on the guide member at the elongate bar for engaging one of the lever and the elongate bar at the guide member for releasibly latching the elongate bar at the upwardly displaced position thereof.

3. A snowmobile jack, said jack comprising:

a base frame for resting on a ground surface;

an elongate guide member attached to said base frame and extending upwardly therefrom, said guide member having a slot thereon, said slot extending upwardly from the said base frame;

an elongate bar, said bar extending upwardly from the base frame and within the said guide member, said bar slidable within the said guide member, said bar having a top end and a bottom end, said top end having support means thereon for engaging a rear portion of a snowmobile for lifting thereof, said support means being adjustable longitudinally of said elongate bar;

a foot lever having a first end and a second end, a fulcrum attached between the first end and the second end allowing pivotal movement about a substantially horizontal axis, said first end including means engaged with the bottom end of the elongate bar, said second end having a foot pad thereon, such that depression of the foot pad by the foot of the user causes the first end to be upwardly displaced causing the elongate bar to move to an upwardly displaced position along said slot of said guide member;

said engaging means comprising a horizontal bar attached adjacent the top end of the elongate bar and having two hook members at spaced position along the horizontal bar extending outwardly from the horizontal bar for engaging a rear portion of the snowmobile, and means for adjustment of the horizontal bar to different positions along the length of the elongate bar; and latch means mounted on said guide member adjacent said elongate bar and including a manually graspable portion to allow movement of the latch means and engagement means for engaging one of said lever and said elongate bar for releasibly latching the elongate bar in the upwardly displaced position.

* * * * *